US005685705A

United States Patent [19]

Knöpfel

[11] Patent Number: 5,685,705

[45] Date of Patent: Nov. 11, 1997

[54] METHOD AND APPLIANCE FOR FLAME STABILIZATION IN PREMIXING BURNERS

[75] Inventor: Hans Peter Knöpfel, Besenbüren, Switzerland

[73] Assignee: Asea Brown Boveri AG, Baden, Switzerland

[21] Appl. No.: 394,746

[22] Filed: Feb. 27, 1995

[30] Foreign Application Priority Data

Mar. 11, 1994 [DE] Germany ..... 44 08 256.8

[51] Int. Cl.[6] ..... F23C 5/00

[52] U.S. Cl. ..... 431/8; 431/9; 431/10; 431/115

[58] Field of Search ..... 431/176, 177, 431/285, 8, 115, 116, 9, 10, 175, 354; 60/746, 747, 737, 733

[56] References Cited

U.S. PATENT DOCUMENTS

| | | | |
|---|---|---|---|
| 1,606,719 | 11/1926 | Pollock | 431/175 |
| 1,700,269 | 1/1929 | Loepsinger | 431/354 |
| 1,712,410 | 5/1929 | Thornton | 431/285 |
| 1,910,735 | 5/1933 | Zikesch | 431/285 |
| 1,949,726 | 3/1934 | McKee | 431/176 |
| 2,822,864 | 2/1958 | Black | 431/175 |
| 2,890,746 | 6/1959 | Dollinger | 431/173 |
| 3,180,395 | 4/1965 | Reed | 431/285 |
| 3,217,779 | 11/1965 | Reed et al. | 431/285 |
| 3,228,451 | 1/1966 | Fraser et al. | 431/10 |
| 4,118,171 | 10/1978 | Flanagan et al. | 431/10 |
| 4,343,605 | 8/1982 | Browning | 431/8 |
| 4,671,069 | 6/1987 | Sato et al. | 60/733 |
| 5,473,881 | 12/1995 | Kramnik et al. | 60/746 |

FOREIGN PATENT DOCUMENTS

| | | |
|---|---|---|
| 0321809 | 6/1989 | European Pat. Off. . |
| 3832494A1 | 3/1990 | Germany . |

OTHER PUBLICATIONS

"Lexicon der Energietechnik und Kraftmaschinen", R. von Miller, 1965, p. 381.

*Primary Examiner*—Carroll B. Dority
*Attorney, Agent, or Firm*—Burns, Doane, Swecker & Mathis, L.L.P.

[57] ABSTRACT

A method an apparatus for flame stabilization in premixing burners in installations for heat generation for domestic and industrial purposes with reduced Nox and CO emissions and increased operational reliability includes a premixing burner through which a main combustion mixture is directed. A wall of the premixing burner has a plurality of radial openings located on at least one plane perpendicular to the flow direction of the burner for introducing a gaseous medium of fuel or a fuel and air mixture into the main flow and directed transverse to the main flow. Each of the radial openings is connected to a supply conduit to deliver the gaseous medium.

5 Claims, 4 Drawing Sheets

METHOD AND APPLIANCE FOR FLAME STABILIZATION IN PREMIXING BURNERS

BACKGROUND OF THE INVENTION

1. Field of the Invention

The invention relates to a method and an appliance for flame stabilization in premixing burners in installations for heat generation, in particular for atmospheric combustion.

2. Discussion of Background

In diffusion burners, mechanical flame holders, in particular, are used for flame holding, i.e. to reduce the flow velocity of the combustion mixture relative to its rate of flame propagation. Such flame holders, however, wear relatively rapidly. They are not very suitable for premixing burners because of the danger of flashback. Expensive and complicated designs are required if they are, nevertheless, employed.

A method for flame holding for afterburners is known from LUEGER, Lexikon der Energietechnik und Kraftmaschinen (Lexicon of power technology and internal combustion engines), Stuttgart 1965, p. 381, in which air jets are blown in at high velocity transverse to the airflow. This forms vortex regions which reduce the axial flow velocity and therefore prevent the flame from separating. This method is used for increasing the thrust of jet engines but it cannot be transferred to the flow conditions in installations for heat generation. This method also increases the CO and $NO_x$ emissions because of the additional combustion.

A burner with premixing type combustion is shown in EP-B1-0 321 809, in which the flame stabilization takes place by means of a flame holder without a solid body. In this burner, liquid fuel is introduced axially, or gaseous fuel is introduced radially, and the combustion air for forming the combustion mixture is supplied tangentially in each case.

When such a burner is used in installations for heat generation and generally where premixing burners are used, problems of flame stabilization occur across the control range. At part-load, in particular, the burner changes from premixing operation to diffusion operation because of the decreasing flow velocities of the combustion mixture. On the other hand, the flame can be blown out in the case of excessively high flow velocities. In diffusion operation, overheating of the burner occurs and this is associated with an increase in the emissions of oxides of nitrogen and carbon monoxide. In addition, pulsations occur in the transition range between diffusion operation and premixing operation with, as a result, inadequate operational reliability of the installation.

SUMMARY OF THE INVENTION

The invention attempts to avoid all of these disadvantages. Accordingly, one object of the invention is to provide a novel method and appliance for flame stabilization in premixing burners in installations for heat generation, in particular for atmospheric combustion, which reduce the $NO_x$ and the CO emissions and increase the operational reliability of the burners.

The invention achieves this object, in a method including the step of, by introducing at least one gaseous medium into the premixing burner transverse to the axially directed combustion mixture. For this purpose, a plurality of openings are arranged in the burner wall in at least one plane extending at right angles through the premixing burner and are each connected to one supply conduit for the gaseous medium.

The method and the appliance are particularly suitable for heat generation installations with atmospheric combustion, i.e. for domestic and industrial burners. The advantages of the invention are based, inter alia, on the fact that the gaseous medium introduced transversely into the axially directed combustion mixture is very intensively mixed with the combustion mixture. The improved premixing leads to lower $NO_x$ and CO figures during the combustion process and the lower flow velocity in the wake of the gaseous medium introduced improves the flame holding, i.e. it improves the operational reliability of the premixing burner. Eddies caused by the impingement of the gaseous medium on the combustion mixture lead to the formation of a flame stabilization zone. Because of this turbulence, furthermore, an additional improvement to the premixing is achieved and therefore an additional reduction in the $NO_x$ and CO emissions.

The flame can be kept stable over a larger control range, and its temperature distribution can be improved, by modifying the quantity and velocity of the gaseous medium introduced transversely.

It is particularly expedient for a plurality of transverse jets of the gaseous medium to be introduced into the combustion mixture in the plane extending at right angles through the premixing burner. For this purpose, the openings are arranged centrally or eccentrically in the burner wall and are each connected to one supply conduit for the gaseous medium.

Each gaseous medium transverse jet which impinges on the combustion mixture acts as a flame stabilizer because of the eddying which is formed by the two gas flows. When the gaseous medium is introduced eccentrically to the axial flow direction of the combustion mixture, a swirl is injected into the axial flow and this likewise contributes to the stabilization of the flame.

It is also advantageous for the internal diameter of the burner wall before the openings to be made smaller than or equal to the internal diameter after the openings. This ensures that the flow velocity of the combustion mixture is greater than its rate of flame propagation and therefore prevents the flame from flashing back into the premixing burner. By appropriate selection of the size of the upstream internal diameter of the burner wall, it is possible to guard effectively against flashback of the flame, even at part-load operation. For this purpose, the burner wall, is split before the openings and the front part is fastened releasably to the rear part so that it can be released, i.e. so that it can be exchanged relatively easily.

Introducing the gaseous medium by means of in each case at least one transverse jet in at least two planes directed at right angles relative to the combustion mixture permits stepped combustion, which is associated with the advantage of a further reduction in the $NO_x$ and CO emissions.

Where the gaseous medium introduced into the premixing burner transverse to the axially directed combustion mixture consists of pure combustion gas, the combustion mixture has already been completely prepared when it reaches the stabilization zone of the flame.

In a different embodiment of the invention, fresh air is introduced transversely into the premixing burner as the further gaseous medium and is mixed with the combustion gas, to form a fresh air/combustion gas mixture in the supply conduit, i.e. before it impinges on the axially flowing combustion mixture. The resulting reduction in the flame temperature is associated with an additional reduction in the $NO_x$ and CO figures.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein a plurality of embodiment examples of the invention are represented, using a premixing burner, and wherein.

Only the elements essential to understanding the invention are shown. Elements of the installation not shown are, for example, the inlet and outlet regions of the premixing burner and the adjoining boiler space. The flow direction of the working media is indicated by arrows.

DESCRIPTION OF THE PREFERRED EMBODIMENTS

Figure 1:
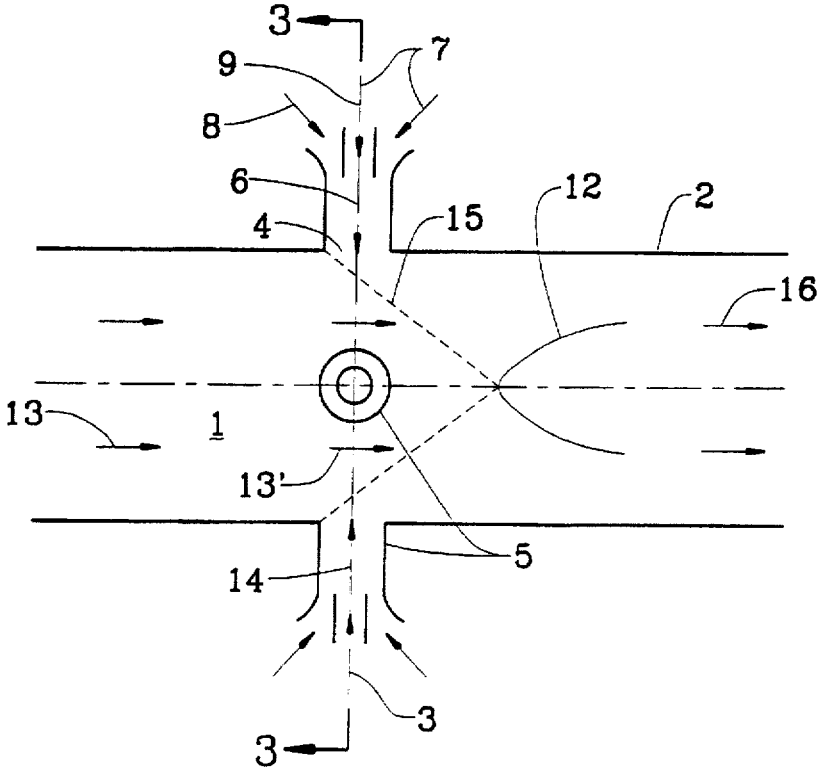
FIG. 1 shows a partial longitudinal section through a premixing burner.

Referring now to the drawings, wherein like reference numerals designate identical or corresponding parts throughout the several views, the premixing burner 1 has a cylindrical burner wall 2. In a plane 3 extending at right angles through the premixing burner 1, the burner wall 2 has four centrally arranged, radial openings 4, each of which is, at the same time, an outlet from a supply conduit 5 for a fresh air/combustion gas mixture 6. The two gaseous media 7, combustion gas 8 and fresh air 9, required for the production of the fresh air/combustion gas mixture are fed into the supply conduit 5 by two conduits (not shown in any more detail) in each case and are mixed together in the supply conduit 5 before entry into the premixing burner 1 (FIG. 1). The internal diameter of the burner wall 2 is configured with the same size both before and after the openings 4.

Figure 2:
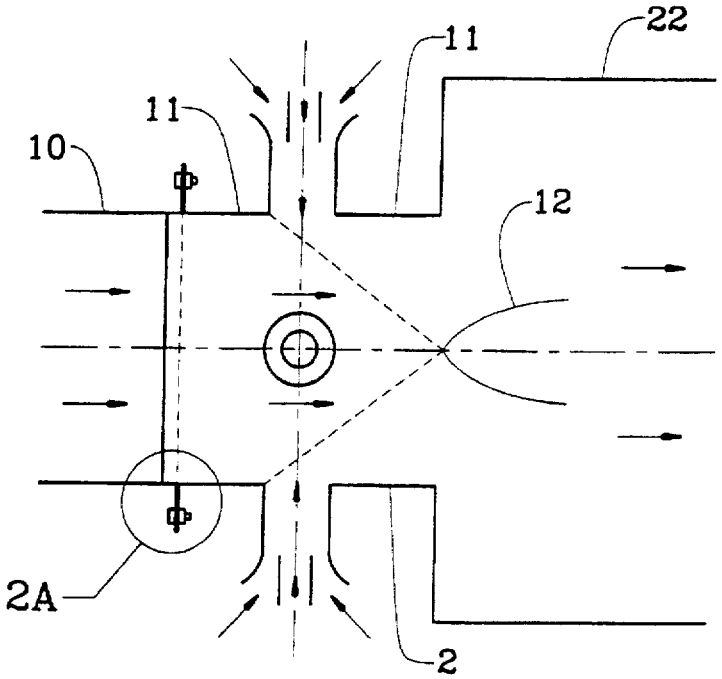
FIG. 2 shows a partial longitudinal section through a premixing burner corresponding to FIG. 1, in a different embodiment.
Figure 2A:
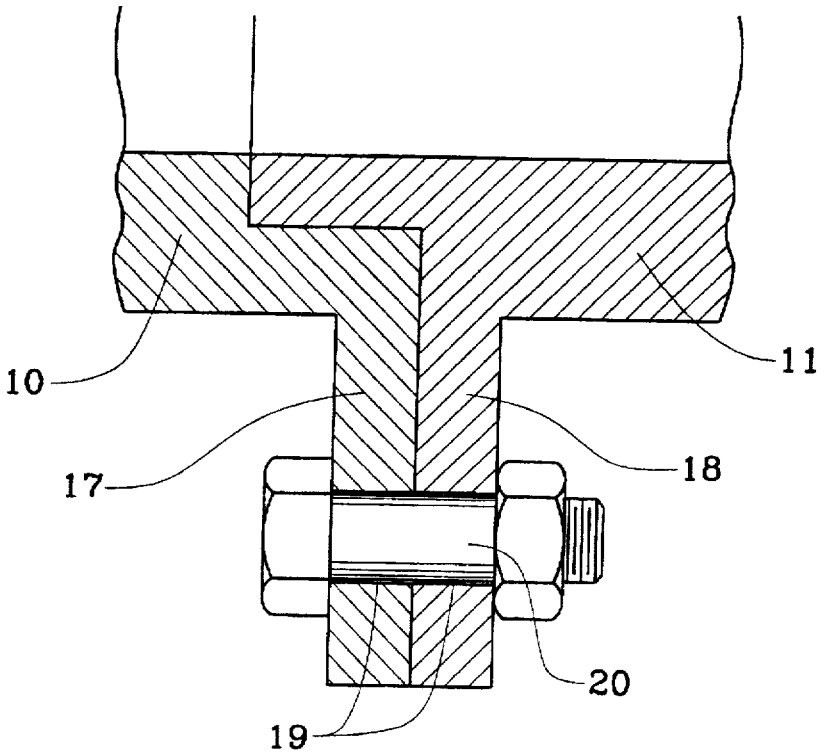
FIG. 2*a*) is an enlarged view of fastening flanges to connect the front and rear parts of the burner.

In a different embodiment of the invention, shown in FIG. 2, the burner wall 2 is split before the openings 4 and the front part 10 is fastened to the rear part 11 so that it can be released, i.e. so that it can be exchanged relatively easily. FIG. 2*a* shows an enlarged view of the circled portion A of FIG. 2. The front part 10 includes a fastening flange 17 that mates with a fastening flange 18 of the rear 11 part. A through hole 19 and a threaded fastener 20 fasten the flanges 17, 18 together. By appropriate selection of the size of the upstream internal diameter of the burner wall 2 relative to a combustion space 22 downstream of the openings 4, it is thus possible to guard effectively against flashback of the flame 12, even at part-load operation (FIG. 2).

Figure 3:
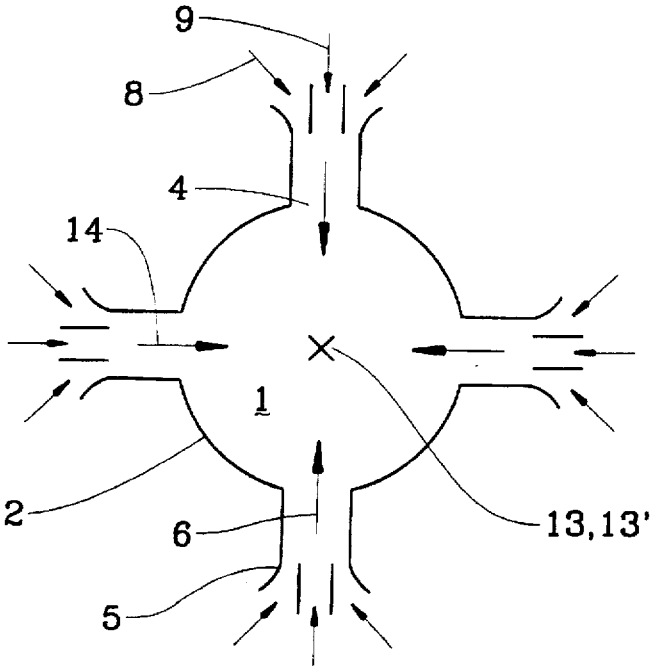
FIG. 3 shows a cross section through the premixing burner along the line III—III in FIG. 1.

A combustion mixture 13 consisting of fuel and air, which can also contain additional combustion gas, is axially guided in the premixing burner 1. The fresh air/combustion gas mixture 6 is introduced into the premixing burner 1 and the combustion mixture 13 through the openings 4 in the form of four transverse jets 14, is jointly prepared with the combustion mixture 13 to form a combustion mixture 13' and is ignited (FIG. 3). In the region where the transverse jets 14 impinge on the combustion mixture 13, intensive eddying takes place between the two gas flows so that a flame stabilization zone 15 is formed there which stabilizes the flame 12 (FIG. 1). The resulting hot combustion gas 16 is led off to a boiler space (not shown) and is further employed there.

Combustion gas 8 can also, of course, be used exclusively as the gaseous medium 7. In this case, the combustion mixture 13' has already been prepared on arrival at the flame stabilization zone 15.

Figure 4:
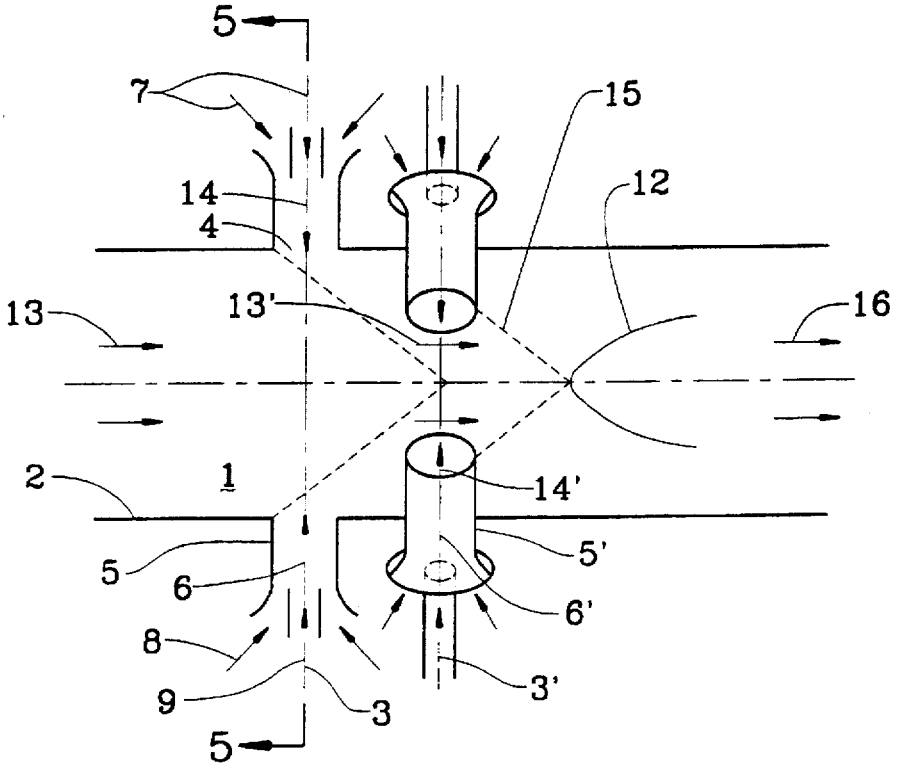
FIG. 4 shows a partial longitudinal section through a premixing burner in a next embodiment.
Figure 5:
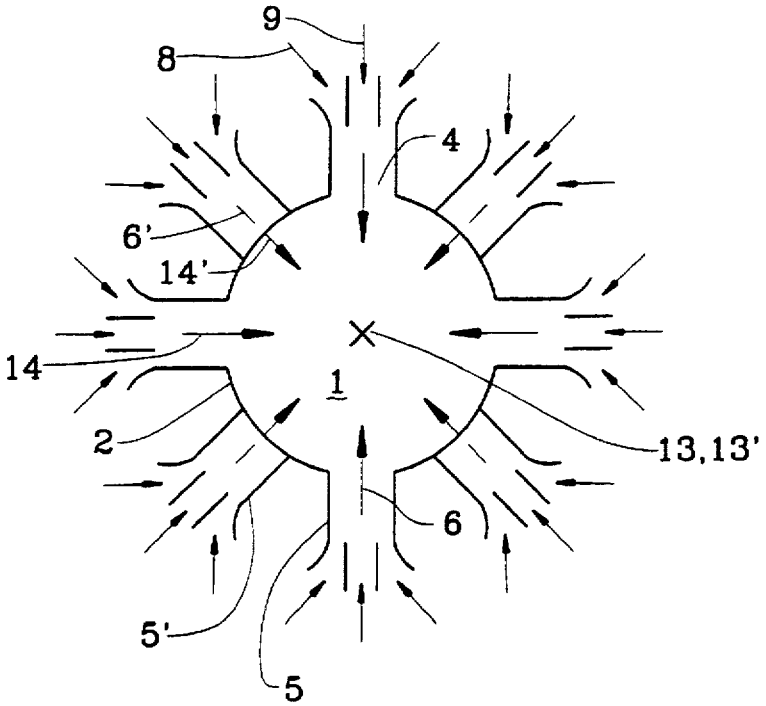
FIG. 5 shows a cross section through the premixing burner along the line V—V in FIG. 4.
Figure 6:
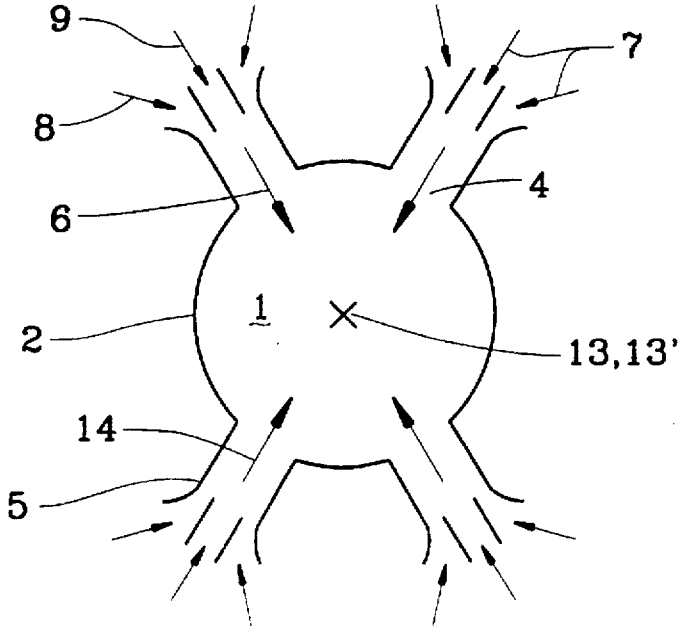
FIG. 6 shows a cross section through a premixing burner in a further embodiment; and, FIG. 7 is a cross sectional view of a burner having eccentrically directed openings.

In a next embodiment example, the fresh air/combustion gas mixture 6 is introduced in two planes 3, 3' directed at right angles to the combustion mixture 13 and likewise by means of four transverse jets 14, 14' in each case (FIG. 4). The supply conduits 5 of the plane 3 are then arranged offset relative to the supply conduits 5' of the plane 3' (FIG. 5). The effect is essentially analogous. Stepped combustion can, however, be achieved if different quantities of the fresh air/combustion gas mixture 6, 6' are supplied in each of the two planes 3, 3'.

Figure 7:
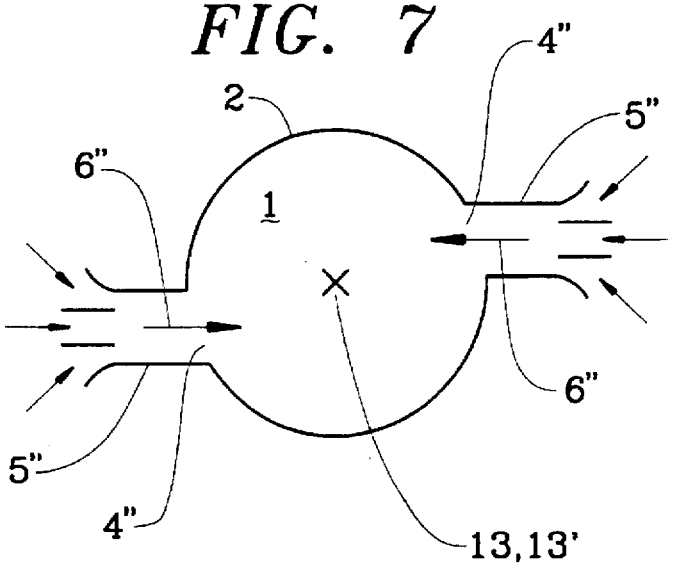

In a further embodiment example, the openings 4 are arranged eccentrically in the burner wall 2. By this means, swirl is injected into the combustion mixture 13 when the transverse jets 14 impinge on it and this contributes additionally to flame stabilization (FIG. 7).

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for flame stabilization in premixing burners in installations for heat generation, comprising the steps of:

forming a combustible fuel and air mixture in a premixing burner;

guiding the combustible mixture as a main flow axially in the premixing burner;

mixing combustion gas and fresh air to form at least one gaseous medium;

introducing the at least one gaseous medium of combustion gas and fresh air into the main flow in the premixing burner transverse to the main flow to penetrate and mix in the main flow to cause eddies in the main flow;

igniting the mixture in the burner downstream of the introduction of the at least one gaseous medium to form hot combustion gas;

wherein the eddies formed by the at least one gaseous medium stabilize a flame formed by the ignited main flow, and, guiding the hot combustion gas from the burner into a boiler space.

2. The method as claimed in claim 1, wherein the plurality of transverse jets are positioned to introduce the at least one gaseous medium eccentrically to the flow direction axis.

3. The method as claimed in claim 1, wherein the at least one gaseous medium is introduced by a plurality of transverse jets oriented in a plane directed at right angles to the main flow combustion mixture.

4. The method as claimed in claim 3, wherein the plurality of transverse jets are positioned centrally to the axial flow direction of the burner.

5. The method as claimed in claim 1, wherein the at least one gaseous medium is introduced in at least two planes directed at right angles to the combustion mixture by at least one transverse jet oriented in each plane, the at least one transverse jet of one plane being circumferentially offset relative to the at least one transverse jet of the other plane.

* * * * *